United States Patent [19]

Bledsoe et al.

[11] Patent Number: 5,016,315

[45] Date of Patent: May 21, 1991

[54] FLOOR CLEANING DEVICE WITH IMPROVED HANDLE GRIP

[75] Inventors: Susan G. Bledsoe, New Lenox, Ill.; Gordon W. Goodrich, Grand Rapids, Mich.

[73] Assignee: Bissell Inc., Grand Rapids, Mich.

[21] Appl. No.: 124,918

[22] Filed: Nov. 24, 1987

Related U.S. Application Data

[63] Continuation of Ser. No. 793,917, Nov. 1, 1985, abandoned.

[51] Int. Cl.[5] ..... A47L 9/32

[52] U.S. Cl. ..... 15/410

[58] Field of Search ..... 15/410, 411, 143 R, 15/143 A, 144 R, 363–392

[56] References Cited

U.S. PATENT DOCUMENTS

| | | | |
|---|---|---|---|
| 690,084 | 12/1901 | Thurman | 15/410 X |
| 826,513 | 7/1906 | Kenney | 15/410 X |
| 1,267,329 | 5/1918 | Merithew | 15/388 |
| 1,530,575 | 3/1925 | Pearl | 15/344 |
| 1,531,131 | 1/1925 | Price | 30/519 |
| 1,692,137 | 11/1928 | Orr | 15/410 X |
| 2,309,583 | 1/1943 | Frantz | 15/410 X |
| 3,667,084 | 6/1972 | Valbona et al. | 15/323 |
| 3,758,914 | 9/1973 | Nupp et al. | 15/329 |
| 3,825,047 | 7/1974 | McManus et al. | 145/31 R |
| 4,155,143 | 5/1979 | Garbe | 15/410 |
| 4,248,284 | 2/1981 | Tomosada | 145/108 R |
| 4,288,886 | 9/1981 | Siegler | 15/330 |
| 4,402,106 | 9/1983 | Mattson | 15/406 |
| 4,428,266 | 1/1984 | Keddie | 145/32 R |
| 4,467,493 | 8/1984 | Buchtel | 15/323 |

FOREIGN PATENT DOCUMENTS

| | | | |
|---|---|---|---|
| 541861 | 4/1956 | Italy | 15/144 R |

OTHER PUBLICATIONS

Meriam, J. L., "Statics", second edition, copyright 1975, John Wiley & Sons, Inc., pp. 16, 70.

*Primary Examiner*—Harvey C. Hornsby
*Assistant Examiner*—Scott J. Haugland
*Attorney, Agent, or Firm*—Price, Heneveld, Cooper, DeWitt & Litton

[57] ABSTRACT

A carpet sweeper, vacuum cleaner or other upright floor cleaning device includes a base unit (2) and a handle (6) freely pivoted on the base unit for translation over a floor (3). The handle pivots in a vertical plane (9) extending transverse to the base unit support wheel axles (5). A handle grip (10) includes a first grip portion (12) which is coaxial with the handle and forms an extension thereof. The outer end of the first grip portion connects with a second grip portion (14) which comprises an arm (15) graspable by the operator, with the arm extending forwardly (upwardly when in use) of the handle. The arm is disposed in the vertical plane (9) and is bowed or curved from its point of anchorage with the first grip portion (12) to its opposite end, which is disposed in a plane (19) transverse to the first grip portion and passing between the latter's ends. The curvature of the outer arm surface is adapted to nest in a cup formed by the operator's closed hand. The said opposite end of the arm merges into a third grip portion which forms a brace (20) extending diagonally rearwardly (downwardly when in use) back to and connecting with the first grip portion. Instead of the operator's fingers being arrayed along the handle at an acute angle to a horizontal plane containing the wheel axles (5), as in prior upright cleaning devices, the fingers are arrayed normal to the pivotable handle and at an obtuse angle to the axles, thus creating a stronger wrist position. Also, since the handle is effectively below the grip during use, the handle itself is pivotally positioned at a smaller angle to the floor than previously.

8 Claims, 2 Drawing Sheets

FLOOR CLEANING DEVICE WITH IMPROVED HANDLE GRIP

This is a continuation of application Ser. No. 06/793,917, filed Nov. 1, 1985, now abandoned.

BACKGROUND AND SUMMARY OF THE INVENTION

This invention relates to a floor cleaning device with an improved handle grip. More particularly, the invention is directed to upright floor cleaning devices such as carpet sweepers, vacuum cleaners and the like which include a base unit which is reciprocable over the floor by a standing operator, who manipulates the device through an elongated handle which is pivotable on the base unit, and thus relative to the floor during use.

Handles for such cleaning devices have previously been constructed so that their upper terminus end portions, comprising a grip for the operator's hand, have been merely straight continuations of the handle, or have been curved slightly rearwardly and downwardly so that the curved portion was generally parallel to the floor during use of the device. The result has been that the operator's wrist has been in a generally weak position when holding the grip. Furthermore, the acute angle between the pivoting handle and floor during use of such known devices has been relatively large, causing the operator to use a relatively high amount of force when translating the cleaning device over the floor.

Other types of handles have been previously utilized for various devices over the years. See, for example, the vacuum cleaner handle disclosed in U.S. Pat. No. 1,530,575, and various saw handles such as those disclosed in U.S. Pat. Nos. 1,531,131, 3,825,047, 4,248,284 and 4,428,266. However, none of these handles form part of an upright floor cleaning device wherein the handle is freely pivotable about a floor cleaning base unit.

It is an object of the present invention to provide a handle grip for an upright floor cleaning device of the type discussed above, wherein the operator's wrist is disposed in a substantially stronger position than in the known upright cleaning devices. It is a further object of the invention to provide a handle grip which permits the pivoting handle to be positioned at a smaller acute to the floor during use, thus lessening the amount of force required to translate the cleaning device over the floor.

In accordance with the various aspects of the invention, the handle grip includes a generally straight first portion which is essentially coaxial with the pivotable elongated handle of the cleaning device and which, in this embodiment, forms an extension of the handle. The outer end portion of the grip's first portion connects with a second grip portion which comprises an arm which is graspable by the operator, with the arm extending forwardly (upwardly when in use) of the handle. The arm is disposed in a vertical plane which is coextensive with and extends through the handle and which is transverse to the wheel axles of the lower unit. In the present embodiment, the arm is bowed or curved from its point of anchorage with the first grip portion to its opposite end, which is disposed in a plane transverse to the first grip portion and passing between the latter's ends. The curvature of the outer arm surface is adapted to nest in a cup formed by the operator's closed hand. The said opposite end of the arm merges into a third grip portion which forms a brace extending diagonally rearwardly (downwardly when in use) back to and connecting with the first grip portion, forming an acute angle therewith.

Instead of the operator's fingers being arrayed along the handle, at an acute angle to a horizontal plane containing the wheel axles, as in the prior upright cleaning devices, the fingers are arrayed normal to the pivotable handle and at an obtuse angle to the axles, thus creating a stronger wrist position. Also, since the handle is effectively below the grip during use, the handle itself is pivotally positioned at a smaller angle to the floor than previously.

BRIEF DESCRIPTION OF THE DRAWINGS

The accompanying drawings illustrate the best mode presently contemplated by the inventors for carrying out the invention.

In the drawings.

DESCRIPTION OF THE PREFERRED EMBODIMENT

Figure 1:
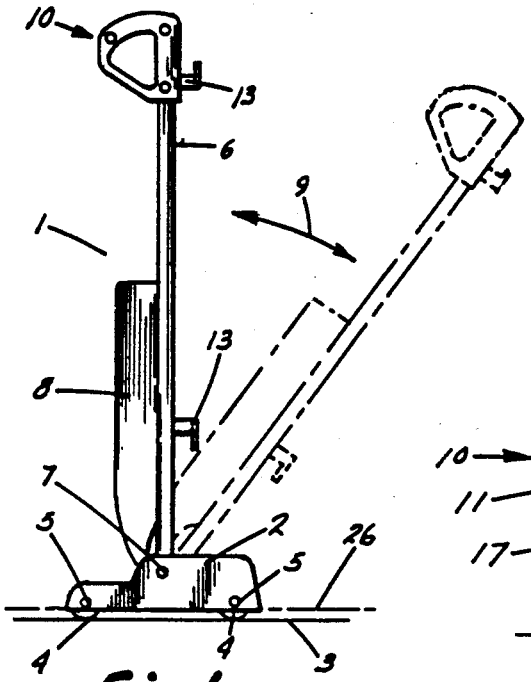
FIG. 1 is a schematic side elevation of an upright cleaning device which incorporates the various aspects of the invention.

As shown in FIG. 1, the various aspects of the invention are incorporated in combination with an upright floor cleaning device 1 which could be a carpet sweeper or the like but which in the present embodiment comprises a vacuum cleaner having a base unit 2 adapted to be reciprocably translated over a floor 3. Base unit 2 is rollingly supported on floor 3 by a plurality of wheels 4 mounted on transverse axles 5. The floor cleaning mechanism disposed within the housing of base unit 2 is not shown but may be of any conventional well-known type. An elongated handle 6 extends upwardly from base unit 2 and is secured at its lower end for free pivotal movement about a transverse pivot axis 7 which is parallel to axles 5. The lower securement of handle 6 is also not shown, but is of any conventional type so that during use, the handle is freely pivotable relative to the plane of floor 3. See FIG. 6. In the present embodiment, a vacuum cleaner bag 8 is connected to the cleaning mechanism of base unit 2 and is suitably secured to handle 6.

Handle 6 is disposed for movement in a plane 9 which is disposed vertically to floor 3 and passes through base unit 2, and which is also normal to axles 5 and pivot axis 7.

Figure 2:
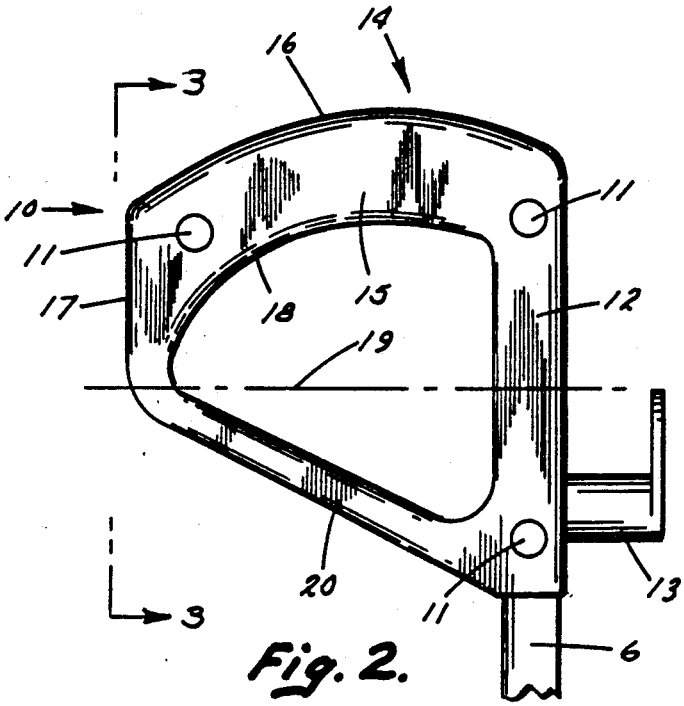
FIG. 2 is an enlarged side elevation of the handle grip shown in FIG. 1.
Figure 3:
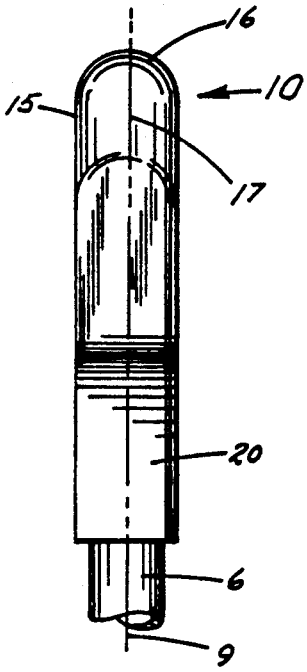
FIG. 3 is a front elevational view of the handle grip, taken on line 3—3 of FIG. 2.

Referring to FIGS. 2 and 3, the upper end of handle 6 is provided with a handle grip 10 which in the present embodiment constitutes a pair of plastic halves joined together by suitable securing devices 11, and which also is formed of three grip portions. The first grip portion 12 is generally straight and in the present embodiment is suitably connected to and essentially forms an axial extension of the upper or outer end of handle 6. Grip portion 12 is shown as having a hook 13 disposed thereon, which is adapted to cooperate with a second hook 13 disposed lower on handle 6 for winding an electric cord.

The outer end of first grip portion 12 merges into a second grip portion 14 which comprises an arm 15 which is graspable by the operator. Arm 15 extends forwardly of handle 6 (upwardly when in use—see FIG. 6), and is generally coplanar with plane 9. The arm includes an outer surface which comprises a compound convex end portion 16 which merges at a part remote from first grip portion 12 into a planular portion 17 spaced from and generally parallel to handle 6 and portion 12. The inner surface 18 of arm 15 is generally arcuate and concave.

The outer end portion of arm 15 is disposed in a plane 19 which transverse to first grip portion 12 and which passes through the latter between its ends. The outer end portion of arm 15 merges into a third grip portion 20 which forms a brace which extends diagonally rearwardly (downwardly when in use—see FIG. 6) therefrom and into merging cooperation with first grip portion 12, forming an acute angle therewith and thereby completing the generally planular unitary grip structure of the present embodiment.

FIGS. 4 through 7 of the drawings illustrate the superior advantages obtained by the aspects of the present invention.

Figure 4:
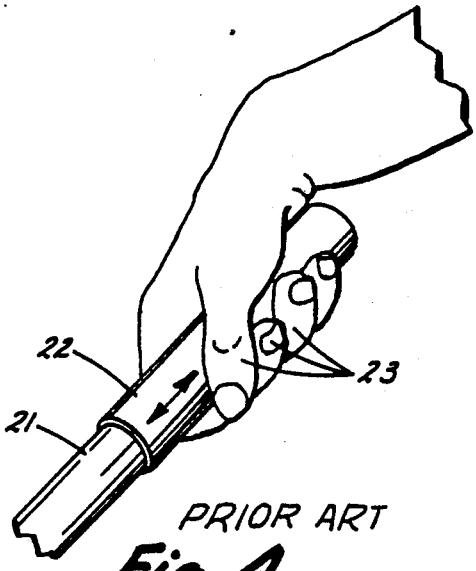
PRIOR ART Fig. 4.
FIG. 4 is a perspective view showing one form of previously known upright cleaner handle being gripped by an operator.
Figure 5:
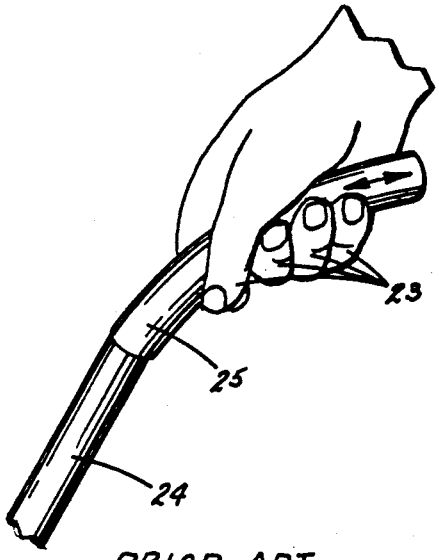
PRIOR ART Fig. 5.
FIG. 5 is a perspective view of another form of previously known upright cleaner handle being gripped by an operator.

FIG. 4 shows a known handle 21 and grip 22 wherein the gripping surface of the latter is nothing but a rubber covered coaxial extension of the former. When handle 21 is angularly held by the operator during use, the operator's fingers 23 are arrayed parallel to and along the graspable handle portion. In the known device of FIG. 5, the handle 24 is generally straight, but the grip 25 is curved rearwardly so that in use, it is generally horizontal. When grip 25 is held by the operator so that handle 24 is disposed at the usual angle during use, the operator's fingers 23 are also arrayed parallel to and along the graspable handle portion. In both prior devices of FIGS. 4 and 5, the operator's fingers 23 are disposed at an acute angle to a horizontal plane 26 containing wheel axles 5. The result is that the forces applied to the cleaning device to move it over the floor are along the handle and transverse to the finger positions, thus resulting in a bendable weak wrist portion. See the arrows.

Figure 6:
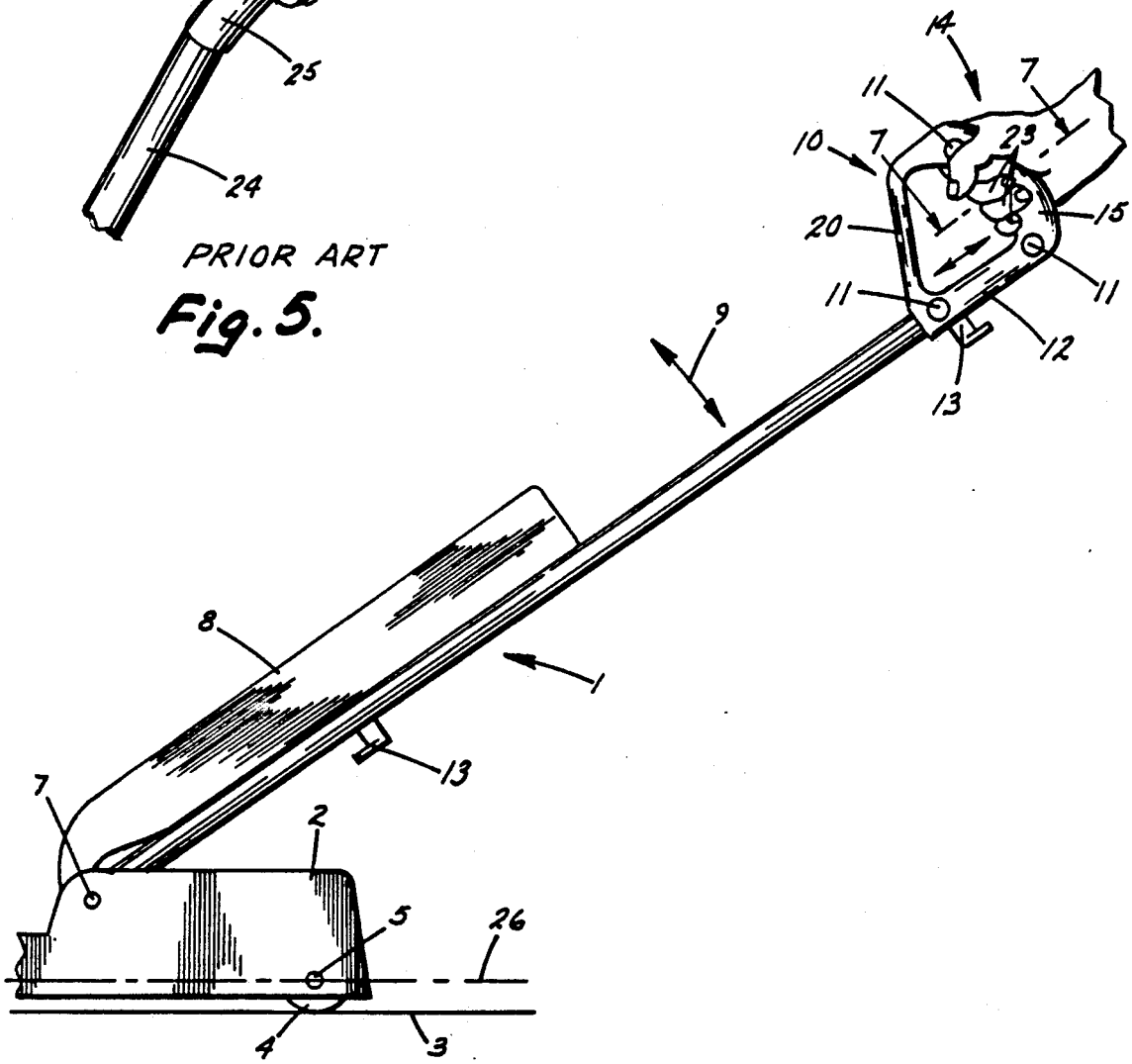
FIG. 6 is a side elevation of the upright cleaning device of the invention, showing its position when in use.

Referring to the present invention and FIG. 6, the operator's fingers 23 are arrayed generally normal to freely pivotable handle 6 and extend generally upwardly therefrom in use, and are also in plane 9. Fingers 23 in this instance are disposed at an obtuse angle to plane 26, so that the forces applied to move cleaning device 1 are applied parallel to the finger positions, as shown by the arrows. These forces extend down the operator's arm and directly through the wrist in such a manner that the wrist is not apt to bend, resulting in a strong wrist position.

Because the handle grip 10 of the invention extends upwardly from handle 6 during reciprocating translation of cleaning device 1 over floor 3, handle 6 will actually be lower and at a smaller angle relative to plane 26 and the floor when arm 15 is grasped, as compared to prior devices where the handle itself is held by the same operator. This minimized angle of the handle, which is below the operator's hand, lowers the force necessary to push and pull the appliance, due to the geometry thereof.

Figure 7:
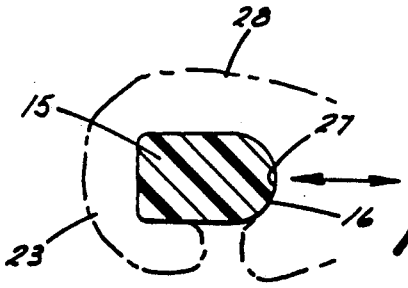
FIG. 7 is a section taken on line 7—7 of FIG. 6.

The particular rounded compound curvature of arm surface 16, as best seen, in FIGS. 2, 3 and 7, is also helpful in that it tends to nest in the cupped inner portion 27 of the operator's closed hand 28 when arm 15 is grasped, thus further effectively increasing the operator's ability to manipulate the device.

Various modes of carrying out the invention are contemplated as being within the scope of the following claims particularly pointing out and distinctly claiming the subject matter which is regarded as the invention.

We claim:

1. An upright floor cleaner comprising in combination:

(a) a base unit for reciprocable translation over a floor to be cleaned, (b) wheel means mounted on axle means and adapted to support said base unit on said floor, (c) an elongated handle pivotally mounted at its inner end to said base unit and thus pivotable relative to said base unit and to said floor during said translation, said handle being sufficiently long that said floor cleaner can be manipulated by a user in a standing position when said base unit is engaging the floor, (d) a handle grip mounted on the outer end of said handle forming a straight extension of said handle and mounted for movement with said handle during use in a plane disposed vertically to a said floor and normal to said axle means, (e) said handle grip including a graspable arm attached to the outer end of said handle grip and extending generally laterally upwardly in a direction away from the floor when in use and at substantially a right angle with respect to the longitudinal axis of said handle during use and being graspable by the hand of a standing operator, (f) said arm being sufficiently long in a direction generally laterally and upwardly away from said handle that it will accommodate the width of a user's hand grasping said arm, so that the forces applied by the said standing operator to translate the device over the floor are applied generally parallel to the operator's fingers to thereby provide a strong wrist position for the operator during said reciprocable translation, and so that said arm positions said handle below the operator's hand to thereby minimize the angle of said handle relative to said floor during use.

2. The upright floor cleaner of claim 1 wherein said graspable arm of said handle grip further includes an outer rear surface having a curved convex portion comprising means to nest in the cupped inner portion of the operator's closed hand during use of the cleaner.

3. The upright floor cleaner of claim 2 wherein said graspable arm (15) of said handle grip (10) further includes an inner surface (18) of generally arcuate concave curvature.

4. The upright floor cleaner of claim 2 in which said curved convex portion merges into a forwardly extending generally planar portion spaced from and generally parallel to said handle.

5. The upright cleaner of claim 1 wherein said handle grip further comprises:

(a) a generally straight grip portion disposed at the upper end portion of said handle and axially aligned therewith, said grip portion having an outer end portion connected to one end of said graspable arm, (b) and a brace connected to the other end of said arm and extending diagonally downwardly into connecting relationship with an inner end portion of said grip portion.

6. The upright cleaner of claim 5 wherein the connection of said brace to the said other end of said graspable arm is disposed in a plane which is transverse to said grip portion and which passes therethrough between its said inner and outer end portions.

7. The upright cleaner of claim 1 in which said arm curves forwardly slightly towards said base unit as it proceeds upwardly away from said longitudinal axis of said handle.

8. The upright cleaner of claim 7 in which said upwardly and forwardly curving arm terminates at a generally diagonal brace which extends from said arm forwardly and downwardly to said longitudinal axis of said handle.

* * * * *